US007320155B2

(12) United States Patent
Leger

(10) Patent No.: US 7,320,155 B2
(45) **Date of Patent: *Jan. 22, 2008**

(54) WEB BUFFERING DEVICE

(75) Inventor: Joachim Leger, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 348 days.

This patent is subject to a terminal disclaimer.

(21) Appl. No.: 11/075,122

(22) Filed: Mar. 8, 2005

(65) Prior Publication Data

US 2005/0193526 A1 Sep. 8, 2005

(30) Foreign Application Priority Data

Mar. 8, 2004 (EP) ..... 04005460

(51) Int. Cl.
*D01G 25/00* (2006.01)

(52) U.S. Cl. ..... 19/296; 19/161.1

(58) Field of Classification Search ..... 19/161.1–163, 19/296; 270/32, 39.05, 40, 41
See application file for complete search history.

(56) References Cited

U.S. PATENT DOCUMENTS 2,962,772 A * 12/1960 Draving et al. ..... 19/163
3,222,730 A 12/1965 Kalwaites
4,984,772 A * 1/1991 Freund ..... 270/30.01
5,007,623 A 4/1991 Unkuri et al.
5,590,442 A 1/1997 Hirschek et al.
RE35,982 E * 12/1998 Freund ..... 191/63
6,662,407 B2 * 12/2003 Bernhardt et al. ..... 19/161.1
2005/0193525 A1 * 9/2005 Leger ..... 19/63
2005/0193526 A1 * 9/2005 Leger ..... 19/163
2005/0217077 A1 * 10/2005 Bastian et al. ..... 19/161.1

FOREIGN PATENT DOCUMENTS

EP 1136600 9/2001

* cited by examiner

*Primary Examiner*—Shaun R. Hurley
(74) *Attorney, Agent, or Firm*—Jansson Shupe & Munger Ltd.

(57) ABSTRACT

Apparatus for variably buffering a web material, the apparatus having two endless transport belts including feed sections in which the belts are juxtaposed, and return sections, the feed and return sections being of varying lengths. In the feed sections, the belts move through a U-shaped path portion, commonly guided over a deflecting roller. In the return sections, the belts are guided through U-shaped path portions extending opposite to the U-shaped path portion of the feed sections, each belt wrapping separate deflecting rollers. The three deflecting rollers are rotatably supported on a common mounting frame movably held in a machine stand for compensated length variation of the feed and return portions.

22 Claims, 2 Drawing Sheets

WEB BUFFERING DEVICE

RELATED APPLICATION

This application claims the benefit of EP 04 005 460.3, filed on Mar. 8, 2004, the contents of which are incorporated herein.

FIELD OF THE INVENTION

This invention is related generally to the field of web handling machinery. More particularly, the invention relates to the control of the speed of web material in web handling machinery in situations in which the relative speeds of different portions of the web fluctuate with respect to each other.

BACKGROUND OF THE INVENTION

U.S. Pat. No. 5,590,442 describes web storage apparatus for non-woven fabrics. The web storage apparatus is located between a web producer and web processing apparatus, e.g., between a carding machine, operating at constant output speed, and fabric laying apparatus, operating at rhythmically variable take-up speeds. In such fabric laying apparatus, the transport speed of the web within the machine changes during transport depending on the movements of the laying carriage within the fabric laying apparatus. The web storage apparatus is controlled in accordance with the transport speed of the laying belts of the fabric laying apparatus, such transport speed fluctuating with the rhythm of the absolute traveling speed of the laying carriage.

This known web storage apparatus consists of a U-shaped section of variable length of an endless belt conveyor extending between the web producer and the fabric laying apparatus. The web storage apparatus supplies the web output from the web producer, which produces web material at a substantially constant speed, to the fabric laying apparatus, which requires web material to be supplied to it at a fluctuating speed. The length of the U-shaped section (and thereby the length of the path that web material must travel) is varied by displacing a frame which holds a pair of deflecting rollers. A carriage-mounted endless support belt aligns with the conveyor belt in its U-shaped section, and in this section, the support belt tightly contacts the conveyor belt, thereby clamping the web material between these two belts. The web storage apparatus is therefore capable of controlling the regular web supply speed of the web producer in accordance with the variable take-up speed of the web processing apparatus.

In order to accomplish the changes in the path length, also known as web buffering, the movements of the frame and the carriage must be matched with one another, which requires special effort, since a sufficient tension of the conveyor belt must always be ensured to maintain the clamping effect between the conveyor belt and the support belt in order to prevent any damage of the sensitive, unsolidified web material in the web storage apparatus. Such coordinated control is both complex and costly. Further, along some portions of the web path from the infeed from the web producer to the outfeed to the web processing apparatus, the web material is not fully clamped, leaving the web material susceptible to disturbances from drafts. Thus there is a need for web buffering apparatus which can provide the web speed-matching function between various pieces of equipment in less costly, less complex manner and provide protection for the web while maintaining a high quality level in the web material.

OBJECTS OF THE INVENTION

It is an object of the invention to provide improved web buffering apparatus which overcomes some of the problems and shortcomings of the prior art, including those referred to above.

Another object of the invention is to provide web buffering apparatus which is easily controlled.

Another object of the invention is to provide web buffering apparatus which interfaces more easily with certain web processing apparatus.

Still another object of the invention is to provide web buffering apparatus which protects the web material along its path through the buffering apparatus.

Yet another object if the invention is to provide web buffering apparatus which is structurally simple.

How these and other objects are accomplished will become apparent from the following descriptions and the drawings.

SUMMARY OF THE INVENTION

The apparatus of this invention takes up a web material supplied at a take-up speed and outputs this material at a discharge speed which fluctuates with respect to take-up speed but on average matches take-up speed. The inventive apparatus includes two endless transport belts which together define a take-up site for receiving the web material therebetween and which further include a discharge site for outputting the web material. The transport belts are guided in juxtaposition between the take-up site and the discharge site to clamp the web material between the belts. Each transport belt includes and feed section and a return section. Each feed section is of varying length and has a substantially U-shaped feed path portion. The belts in such feed sections together are guided over a first deflecting roller substantially half-wrapped by the belts. Each return section is also varying length, and the belts in such return sections are separately guided from the discharge site to the take-up site and each runs through a substantially U-shaped return path portion extending opposite to the U-shaped feed path portion and substantially half-wrapping one of second and third deflecting rollers, respectively. The apparatus also includes a common mounting frame rotatably supporting the three deflecting rollers and movable on a machine stand, and the common mounting frame moves substantially parallel to the U-shaped path portions. For each belt, the apparatus enables the length of the feed section to vary with respect to the length of the return section.

In preferred embodiments of the inventive apparatus, the common mounting frame is movably held by a pendulum.

In a preferred embodiment of the apparatus, the common mounting frame is pivotably supported around the axis of the first deflecting roller. Such embodiments may also further include a tensioning roller about which the belt from one of the U-shaped return path portions is substantially half-wrapped. The tensioning roller is biased away from the U-shape of such return path portion.

In other preferred embodiments, the apparatus further includes first and second independent drive rollers and a common drive roller. The transport belts are each guided over one of the independent drive rollers, and their feed sections are commonly guided over the common drive roller, the common drive roller being driven at a circumferential speed that is variable with respect to the circumferential speeds of the first and second independent drive rollers. In such apparatus, the discharge speed is thus varied with respect to the take-up speed.

Another preferred embodiment of the inventive apparatus also includes first and second independent drive rollers. The transport belts are each guided over one of the independent drive rollers, and the first deflecting roller is also a drive roller driven at a circumferential speed that is variable with respect to the circumferential speeds of the first and second independent drive rollers, whereby the discharge speed of the apparatus is varied with respect to the take-up speed of the apparatus.

In a highly-preferred embodiment, the apparatus is connected to a camel back cross lapper which includes an endless output conveyor and a series of at least two arms, adjacent pairs of which are pivotably connected at common ends. The series of arms includes a supply arm and a laying arm. The supply arm is pivotably mounted on the machine stand. The layering arm has a layering-arm upper end hinged to the upper end of the adjacent arm and extending therefrom downward to a laying-arm lower end above the output conveyor. The layering-arm lower end is movable transversely with respect to the output conveyor and has two discharge rollers which form a discharge site for the web material. In such apparatus, the transport belts are guided in pairs along the series of arms to the laying-arm lower end, guided separately over the discharge rollers, and separately returned along the arms to the take-up site. In some embodiments, the series of arms consists only of the supply arm and the laying arm.

Another embodiment of the inventive apparatus further includes two return drive rollers and each of the return sections between the supply arm and the U-shaped return path portions wrap at least 90° around a respective one of the return drive rollers.

In other preferred embodiments, each arm of the inventive apparatus has guide rollers alternatingly contacting opposite sides of the juxtaposed feed sections of the transport belts. The apparatus also may include two return drive rollers, each of the return sections between the supply arm and the U-shaped return path portions wrapping at least 90° around a respective one of the return drive rollers.

The drawings only show the essential features of the invention, and this in schematic view only, since a schematic view is sufficient for the understanding the invention.

DETAILED DESCRIPTION OF PREFERRED EMBODIMENTS

Figure 1:
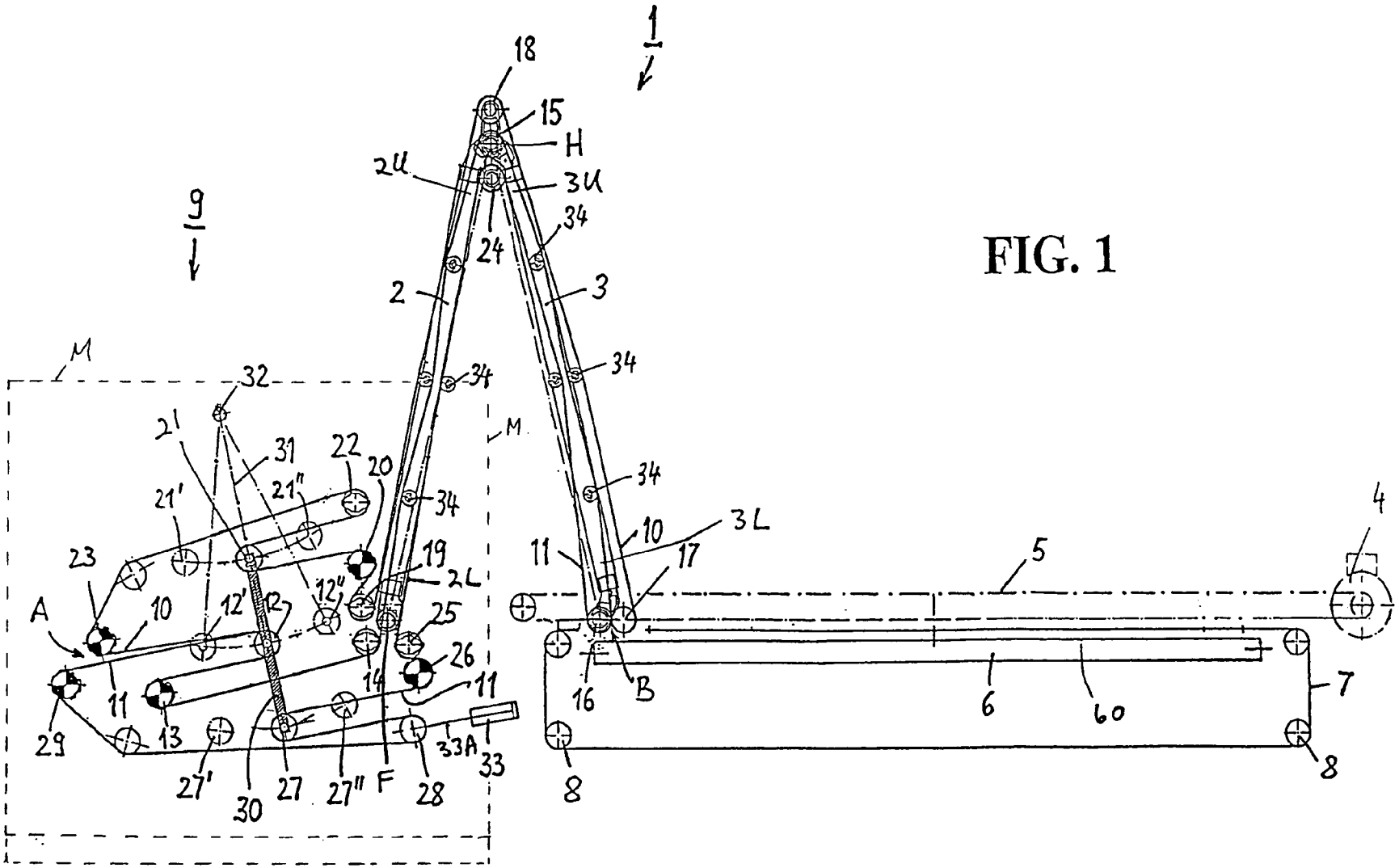
FIG. 1 shows apparatus according to the invention in integral combination with a camel back cross lapper with the laying arm in a retracted position

FIG. 1 shows a first arm 2, also designated as a supply arm, and a second arm 3, also designated as a laying arm, of a camel back cross lapper 1 for fleece production. Supply arm 2 is pivotally supported at its lower end 2L in a machine stand M (shown in dotted line format on FIG. 1). A hinge H at the upper end 2U of the supply arm 2 and the upper end 3U of laying arm 3 provides hinging movement between arms 2 and 3. The lower end 3L of arm laying 3 is capable of being transversely moved above an output conveyor 60 by means of a stationary drive 4 and a toothed belt 5, with a deflecting roller 6 of output conveyor 60 being schematically shown in the drawing. (The apparatus shown in FIGS. 1 and 2 contain numerous deflecting and drive rollers which will be specified primarily by reference number only and not by differentiating names.) Output conveyor 60 extends perpendicularly to the direction of movement of lower end 3L of laying arm 3 and around deflecting roller 6. A cover belt 7 is connected to lower end 3L of laying arm 3. Cover belt 7 is guided over several deflecting rollers 8 on both sides of output conveyor 60 and extends over output conveyor 60 to keep air turbulence away from the laid fleece, the turbulence being caused by the movement of laying arm 3 at a discharge site B at lower end 3L of laying arm 3. Cover belt 7 also serves to avoid formation of folds in the fleece being produced.

Figure 2:
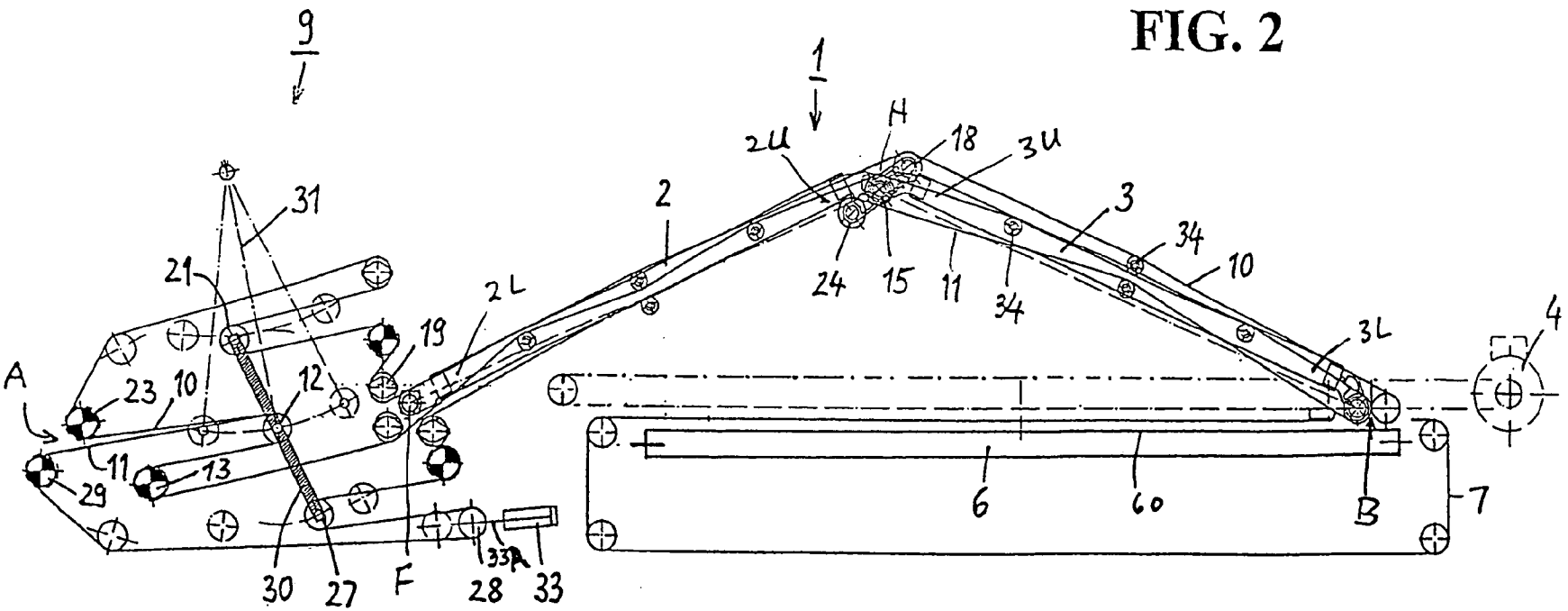
FIG. 2 shows the apparatus of FIG. 1 with the laying arm in an extended position.

FIGS. 1 and 2 show a variable-volume web buffering apparatus 9 to the left of camel back cross lapper 1. Web buffering apparatus 9 comprises two transport belts 10 and 11, each of which runs through web buffering apparatus 9 and which is also guided over arms 2 and 3 of camel back cross lapper 1 up to the discharge site B.

Transport belts 10 and 11 together determine a take-up site A at which fiber web material (not shown) coming from a web generating means (also not shown) and to be layered by cross lapper 1 is supplied into a gap between transport belts 10 and 11. Starting out from take-up site A, transport belts 10 and 11 extend as a pair over a deflecting roller 12, a drive roller 13, a deflecting roller 14 and over arms 2 and 3 of camel back cross lapper 1, wherein belts 10 and 11 are guided at hinge H connecting arms 2 and 3 over a deflecting roller 15. From there, belts 10 and 11 run to two additional deflecting rollers 16 and 17 at lower end 3L of laying arm 3, at which point belts 10 and 11 are separated from one another at discharge site B, to be guided back independently from one another via arms 3 and 2 of cross lapper 1 to take-up site A. Deflecting rollers 16 and 17 together determine discharge site B at which the web supplied by cross lapper 1 is deposited by laying arm 3 onto output conveyor 60 by reciprocating pivotal movements of arms 2 and 3.

As transport belt 10 returns from discharge site B to take-up site A, transport belt 10 runs over a deflecting roller 18 arranged in hinge H of arms 2 and 3. After belt 10 leaves supply arm 2, it runs over a deflecting roller 19 and a drive roller 20. From this point, it runs in a substantially U-shaped path section, the apex of which is formed by a deflecting roller 21, to a deflecting roller 22 and a drive roller 23 at take-up site A.

Transport belt 11 runs over a deflecting roller 24 located at hinge H of the two arms 2 and 3, and after leaving supply arm 2, belt 11 runs over a deflecting roller 25, a drive roller 26, and a U-shaped path section in whose apex a deflecting roller 27 is located, to a deflecting tension roller 28 and a drive roller 29 located at take-up site A.

The deflecting rollers 21 and 27 located in the apexes of the U-shaped path sections of returning transport belts 10 and 11, respectively, are rotatably supported on a common mounting frame 30 in which deflecting roller 12 is also supported. The paired feed sections of the transport belts 10 and 11 thus run around deflecting roller 12. Frame 30 is pivotally supported in the axis of deflecting roller 12 on a frame-like swinging link 31, which is shown in the drawing only schematically with a dash-dotted line and which is suspended like a pendulum in a pivot bearing 32 in machine stand M.

Deflecting tension roller 28 is attached at a piston arm 33A of a hydraulic cylinder 33. A tie force exerted by hydraulic cylinder 33 onto deflecting tension roller 28 provides tension to transport belt 11. The tie force is transferred via deflecting roller 27 and frame 30, which acts as a two-armed lever and which pivots around the axis of deflecting roller 12 that transport belts 10 and 11 have in common, and via deflecting roller 21 onto the return section of transport belt 10. Thus, transport belts 10 and 11 can both be tensioned by a single hydraulic cylinder 33.

On the paths over arms 2 and 3, transport belts 10 and 11 run over several guide rollers 34 supported on arms 2 and 3, some of guide rollers 34 alternatingly contacting both sides of the transport belt sections guided in pairs to prevent flapping of transport belts 10 and 11 along arms 2 and 3.

As long as drive rollers 13, 20, 23, 26 and 29 have identical circumferential speeds, frame 30 rests in the state shown in FIG. 1. When the circumferential speed of drive roller 13 becomes larger than the circumferential speed of the other drive rollers, drive roller 13 draws frame 30 to the left in FIG. 1, through paired transport belts 10 and 11 and deflecting roller 12, decreasing the lengths of the web material feed sections of transport belts 10 and 11. Link 31 supporting frame 30 is thus swung to the left. At the same time, the lengths of the returning sections of transport belts 10 and 11 are increased, since deflecting rollers 21 and 27, supported on frame 30 and deflecting the return sections of the transport belts in a U-shaped manner, are also moved to the left. Positions of deflecting rollers 12, 21 and 27 moved to the left are indicated in the drawing with 12', 21' and 27', respectively. If, however, the drive speed of drive roller 13 becomes smaller with respect to the drive speeds of the other drive rollers, frame 30 moves to the right in FIG. 1 so that deflecting rollers 12, 21 and 27 reach the positions shown in dotted lines by 12", 21" and 27", respectively. Link 31 supporting frame 30 is thereby swung to the right. Since the adjustment of deflecting rollers 12, 21 and 27 takes place in essentially equal amounts, transport belts 10 and 11 remain tensioned.

By the aid of the movement of frame 30 along with link 31, the length of transport belts 10 and 11 between take-up site A and discharge site B can be varied. Thus, it is possible to temporarily change the speed of the web discharge at discharge site B with respect to the web take-up speed at take-up site A. This change is required for cross lapper 1, since the speed at which discharge site B, i.e., lower end 3L of laying arm 3, moves over output conveyor 60, cannot be constant, since in the area of the movement reversal points of arm 3, its speed must be reduced by braking to zero and then accelerated in the opposite direction after the reversal of the movement. If during these braking and acceleration phases arm 3 continued to discharge the web material at the constant speed of transport belts 10 and 11, web upsetting and web thickening would result in marginal portions of the fleece web laid by cross lapper 1, and such variations must be prevented. Thus it is necessary to vary the speed at which the web material is discharged from transport belts 10 and 11, adapting to the speed of laying arm 3 at which this arm moves across output conveyor 60. This variation of the discharge speed of the web material from the gap between deflecting rollers 16 and 17 at discharge site B can be managed by suitable control of the speed of drive rollers 13, 20 and 26 with respect to the speed of drive rollers 23 and 29, wherein frame 30 carries out a substantially swinging movement around pivot bearing 32. This swinging movement moves deflecting rollers 12, 21 and 27 between positions 12', 21' and 27' on the one hand and positions 12", 21" and 27" on the other hand, respectively, and thereby cyclically varies the web volume buffered in the web buffering apparatus.

In a synopsis of FIGS. 1 and 2, a further movement component of frame 30 is now explained. FIG. 2 shows cross lapper 1 in an extended position of supply arm 2 and laying arm 3. It can readily be seen in FIG. 2 that the wrapping angles of transport belts 10 and 11 on deflecting rollers 15, 18 and 24, which are arranged at hinge H of arms 2 and 3, and at deflecting rollers 14, 19 and 25, which are arranged in the area of a fixed bearing point F of supply arm 2, vary from the wrapping angles shown in FIG. 1. While the change of the wrapping angles of the paired transport belt sections and also the change of the wrapping angles at deflecting rollers 18 and 24 located at hinge H of the arms 2 and 3 do not have opposite influences on transport belts 10 and 11 as far as the return sections thereof are concerned, the wrapping angle of the returning section of transport belt 10 at deflecting roller 19 in FIG. 2 is smaller compared to the position shown in FIG. 1. However, the wrapping angle of the returning section of the other transport belt (belt 11) at deflecting roller 25 is larger than in the position shown in FIG. 1. Such wrapping angles of transport belts 10 and 11 therefore change in opposite directions. Transport belt 10 requires an increase in the running path length of its returning section, while transport belt 11 requires a decrease in the running path length of its returning section. Both can be achieved by the aid of tension roller 28, which is influenced by hydraulic cylinder 33, which, as shown in FIG. 2, draws tension roller 28 to the right, resulting in frame 30 being pivoted on swinging link 31 counter-clockwise from its position shown in FIG. 1 into the position shown in FIG. 2. The length of the returning section of transport belt 11 is decreased, and at the same time, the length of the returning section of transport belt 10 is increased.

It is obvious that the swinging movements of frame 30 around pivot bearing 32 of pivotal link 31 and the pivoting movements of frame 30 at swinging link 31 around the axis of deflecting roller 12 deflecting paired transport belts 10 and 11 combine in operation, since the compensation of the speed difference of transport belts 10 and 11 at discharge site B and take-up site A and the compensation of the change in the opposite direction of roller wrapping angles must take place simultaneously.

As an example, the laying width on output conveyor 60 can be 3,500 mm. The length of arms 2 and 3 between deflecting roller 24 and the ends of the arms is approximately 2,800 mm each. Transport belts 10 and 11 each have a length of 21,500 mm. The maximum movement path of camel back cross lapper 1 is 4,000 mm. In the retracted state of arms 2 and 3, as shown in FIG. 1, arms 2 and 3 include an angle of approximately 27°, whereas in the extended position shown in FIG. 2, arms 2 and 3 include an angle of approximately 133°. The difference in the yielding of transport belts 10 and 11 caused by the change of the wrapping angle at deflecting rollers 19 and 25 (in turn caused by the different arm positions during extension, i.e. when the angle included between arms 2 and 3 is enlarged), is compensated by an adjustment of approximately 200 mm on tension roller 28 by means of hydraulic cylinder 33. Frame-shaped swinging link 31, at which frame 30 is pivotally suspended, has an effective length (pendulum length) of 1,400 mm, whereas the distance of deflecting rollers 21 and 27 at frame 30 from deflecting roller 12 common to transport belts 10 and 11 is 520 mm each. For accommodating web buffering apparatus 9, a space of approximately 2,100 mm in front of camel back cross lapper 1 and of a height of approximately 1,750 mm is required, including swinging link arrangement 31.

A variety of alternatives are possible and are obvious to a person skilled in the art of the present invention. Common deflecting roller 12 supported in frame 30 could be, for instance, a drive roller, with roller 13 serving as an idling deflecting roller. Furthermore, deflecting rollers 21 and 27 supported on frame 30 may be drive rollers, with rollers 20 and 26 serving as idling deflecting rollers. Frame 30, instead of being suspended on swinging link 31, could be pivotally supported in a carriage movable on rails. Furthermore, cross lapper 1 could have four pivotably-connected arms for achieving a larger laying width, such arms being arranged and movable in accordion-like fashion to avoid an increase of the height of cross lapper 1. Transport belts 10 and 11 would then be guided in pairs over all four arms so that the web is held along its entire path by tightly contacting transport belts.

While the principles of the invention have been shown and described in connection with specific embodiments, it is to be understood that such embodiments are by way of example and are not limiting.

The invention claimed is:

1. Apparatus for taking up a web material supplied at a take-up speed and for outputting the material at a discharge speed which fluctuates with respect to take-up speed but on average matches the take-up speed, comprising:

two endless transport belts together defining a take-up site for receiving the web material therebetween and a discharge site for outputting the web material, such transport belts being guided in juxtaposition between the take-up site and the discharge site to substantially continuously clamp the web material between the belts, each transport belt including:

a feed section of varying length and having a substantially U-shaped feed path portion, the belts in such feed sections together being guided over a first deflecting roller substantially half-wrapped by the belts, and a return section of varying length, the belts in such return sections being separately guided from the discharge site to the take-up site and each running through a substantially U-shaped return path portion extending opposite to the U-shaped feed path portion and substantially half-wrapping one of second and third deflecting rollers, respectively; and a common mounting frame rotatably supporting the three deflecting rollers and movable on a machine stand, the common mounting frame moving substantially parallel to the U-shaped path portions, whereby for each belt the length of the feed section varies with respect to the length of the return section and the web material is protected through substantially the entirety of the transport path.

2. The apparatus of claim 1 wherein the common mounting frame is pivotably supported around the axis of the first deflecting roller.

3. The apparatus of claim 1 further including a tensioning roller about which the belt from one of the U-shaped return path portions is substantially half-wrapped, the tensioning roller being biased away from the U-shape of such return path portion.

4. The apparatus of claim 1 further including first and second independent drive rollers and a common drive roller, wherein the transport belts are each guided over one of the independent drive rollers and their feed sections are commonly guided over the common drive roller, the common drive roller being driven at a circumferential speed that is variable with respect to the circumferential speeds of the first and second independent drive rollers, whereby the discharge speed of the apparatus is varied with respect to the take-up speed of the apparatus.

5. The apparatus of claim 1 further including first and second independent drive rollers, wherein the transport belts are each guided over one of the independent drive rollers and the first deflecting roller is also a driven roller, the first deflecting roller being driven at a circumferential speed that is variable with respect to the circumferential speeds of the first and second independent drive rollers, whereby the discharge speed of the apparatus is varied with respect to the take-up speed of the apparatus.

6. The apparatus of claim 1 connected to a camel back cross lapper which includes an endless output conveyor and a series of at least two arms, adjacent pairs of which are pivotably connected at common ends, the series including:

a supply arm pivotably mounted on the machine stand; and a laying arm having a laying-arm upper end hinged to the upper end of the adjacent arm and extending therefrom downward to a laying-arm lower end above the output conveyor, the laying-arm lower end being movable transversely with respect to the output conveyor and having two discharge rollers forming a discharge site for the web material, wherein the transport belts are guided in pairs along the series of arms to the laying-arm lower end, guided separately over the discharge rollers, and separately returned along the arms to the take-up site.

7. The apparatus of claim 6 wherein the series consists of the supply arm and the laying arm.

8. The apparatus of claim 6 further including two return drive rollers, each of the return sections between the supply arm and the U-shaped return path portions wrapping at least 90° around a respective one of the return drive rollers.

9. The apparatus of claim 6 wherein the arms each has guide rollers alternatingly contacting opposite sides of the juxtaposed feed sections of the transport belts.

10. The apparatus of claim 9 further including two return drive rollers, each of the return sections between the supply arm and the U-shaped return path portions wrapping at least 90° around a respective one of the return drive rollers.

11. The apparatus of claim 10 wherein the series consists of the supply arm and the laying arm.

12. The apparatus of claim 1 wherein the common mounting frame is movably held by a pendulum.

13. The apparatus of claim 12 wherein the common mounting frame is pivotably supported around the axis of the first deflecting roller.

14. The apparatus of claim 12 further including a tensioning roller about which the belt from one of the U-shaped return path portions is substantially half-wrapped, the tensioning roller being biased away from the U-shape of such return path portion.

15. The apparatus of claim 12 further including first and second independent drive rollers and a common drive roller, wherein the transport belts are each guided over one of the independent drive rollers and their feed sections are commonly guided over the common drive roller, the common drive roller being driven at a circumferential speed that is variable with respect to the circumferential speeds of the first and second independent drive rollers, whereby the discharge speed of the apparatus is varied with respect to the take-up speed of the apparatus.

16. The apparatus of claim 12 further including first and second independent drive rollers, wherein the transport belts are each guided over one of the independent drive rollers and the first deflecting roller is also a driven roller, the first deflecting roller being driven at a circumferential speed that is variable with respect to the circumferential speeds of the first and second independent drive rollers, whereby the discharge speed of the apparatus is varied with respect to the take-up speed of the apparatus.

17. The apparatus of claim 12 connected to a camel back cross lapper which includes an endless output conveyor and a series of at least two arms, adjacent pairs of which are pivotably connected at common ends, the series including:

a supply arm pivotably mounted on the machine stand; and a laying arm having a laying-arm upper end hinged to the upper end of the adjacent arm and extending therefrom downward to a laying-arm lower end above the output conveyor, the laying-arm lower end being movable transversely with respect to the output conveyor and having two discharge rollers forming a discharge site for the web material, wherein the transport belts are guided in pairs along the series of arms to the arm laying-arm lower end, guided separately over the discharge rollers, and separately returned along the arms to the take-up site.

18. The apparatus of claim 17 wherein the series consists of the supply arm and the laying arm.

19. The apparatus of claim 17 further including two return drive rollers, each of the return sections between the supply arm and the U-shaped return path portions wrapping at least 90° around a respective one of the return drive rollers.

20. The apparatus of claim 17 wherein the arms each has guide rollers alternatingly contacting opposite sides of the juxtaposed feed sections of the transport belts.

21. The apparatus of claim 20 further including two return drive rollers, each of the return sections between the supply arm and the U-shaped return path portions wrapping at least 90° around a respective one of the return drive rollers.

22. The apparatus of claim 21 wherein the series consists of the supply arm and the laying arm.

* * * * *